US012061058B2

(12) United States Patent
Moore

(10) Patent No.: US 12,061,058 B2
(45) Date of Patent: Aug. 13, 2024

(54) DROP-IN FULL AUTOMATIC TRIGGER GROUPS

(71) Applicant: Jonathan Moore, Far West, UT (US)

(72) Inventor: Jonathan Moore, Far West, UT (US)

( * ) Notice: Subject to any disclaimer, the term of this patent is extended or adjusted under 35 U.S.C. 154(b) by 0 days.

(21) Appl. No.: 18/067,725

(22) Filed: Dec. 19, 2022

(65) Prior Publication Data

US 2024/0200896 A1 Jun. 20, 2024

(51) Int. Cl.

| | |
|---|---|
| ***F41A 19/15*** | (2006.01) |
| ***F41A 3/66*** | (2006.01) |
| ***F41A 19/10*** | (2006.01) |
| ***F41A 19/12*** | (2006.01) |
| ***F41A 19/14*** | (2006.01) |

(52) U.S. Cl.

CPC ..... *F41A 19/15* (2013.01); *F41A 3/66* (2013.01); *F41A 19/10* (2013.01); *F41A 19/12* (2013.01); *F41A 19/14* (2013.01)

(58) Field of Classification Search

CPC ..... F41A 19/15; F41A 19/43

See application file for complete search history.

(56) References Cited

U.S. PATENT DOCUMENTS

| | | | | |
|---|---|---|---|---|
| 9,671,187 | B2 * | 6/2017 | Colman | F41A 19/15 |
| 2023/0228511 | A1 * | 7/2023 | Werdnig | F41A 19/15 42/69.01 |

* cited by examiner

*Primary Examiner* — Reginald S Tillman, Jr.

(74) *Attorney, Agent, or Firm* — Miller IP Law; Devin Miller

(57) ABSTRACT

Described herein are examples of drop-in full automatic trigger groups. A drop-in full automatic trigger group may be configured for installation within a lower receiver of a firearm. The trigger group may a housing defined by a first trigger pin hole, a first hammer pin hole, and a first sear pin hole; a second trigger pin hole substantially collinear with the first trigger pin hole, a second hammer pin hole substantially collinear with the first hammer pin hole, and a second sear pin hole substantially collinear with the first sear pin hole. The trigger group may include a trigger mechanism disposed at least partially within the housing. The trigger group may include a hammer mechanism disposed at least partially within the housing. The trigger group may include a sear mechanism disposed at least partially within the housing.

20 Claims, 8 Drawing Sheets

DROP-IN FULL AUTOMATIC TRIGGER GROUPS

BACKGROUND

Full-automatic machine guns generally include firearms capable of and/or designed to discharge multiple rounds provided that the firing interface (e.g., the trigger) remains activated (e.g., squeezed). In many situations, the availability of full-automatic machine guns to law enforcement and military personnel provide a distinct advantage, whether in actual situations involving firefights or via a deterrence effect. Many firearms, including rifles and carbines, may include an upper receiver and a lower receiver including a portion of the action.

BRIEF DESCRIPTION OF THE DRAWINGS

The present description will be understood more fully when viewed in conjunction with the accompanying drawings of various examples of drop-in full automatic trigger groups. The description is not meant to limit the drop-in full automatic trigger groups to the specific examples. Rather, the specific examples depicted and described are provided for explanation and understanding of drop-in full automatic trigger groups. Throughout the description the drawings may be referred to as drawings, figures, and/or FIGS.

DETAILED DESCRIPTION

Figure 1:
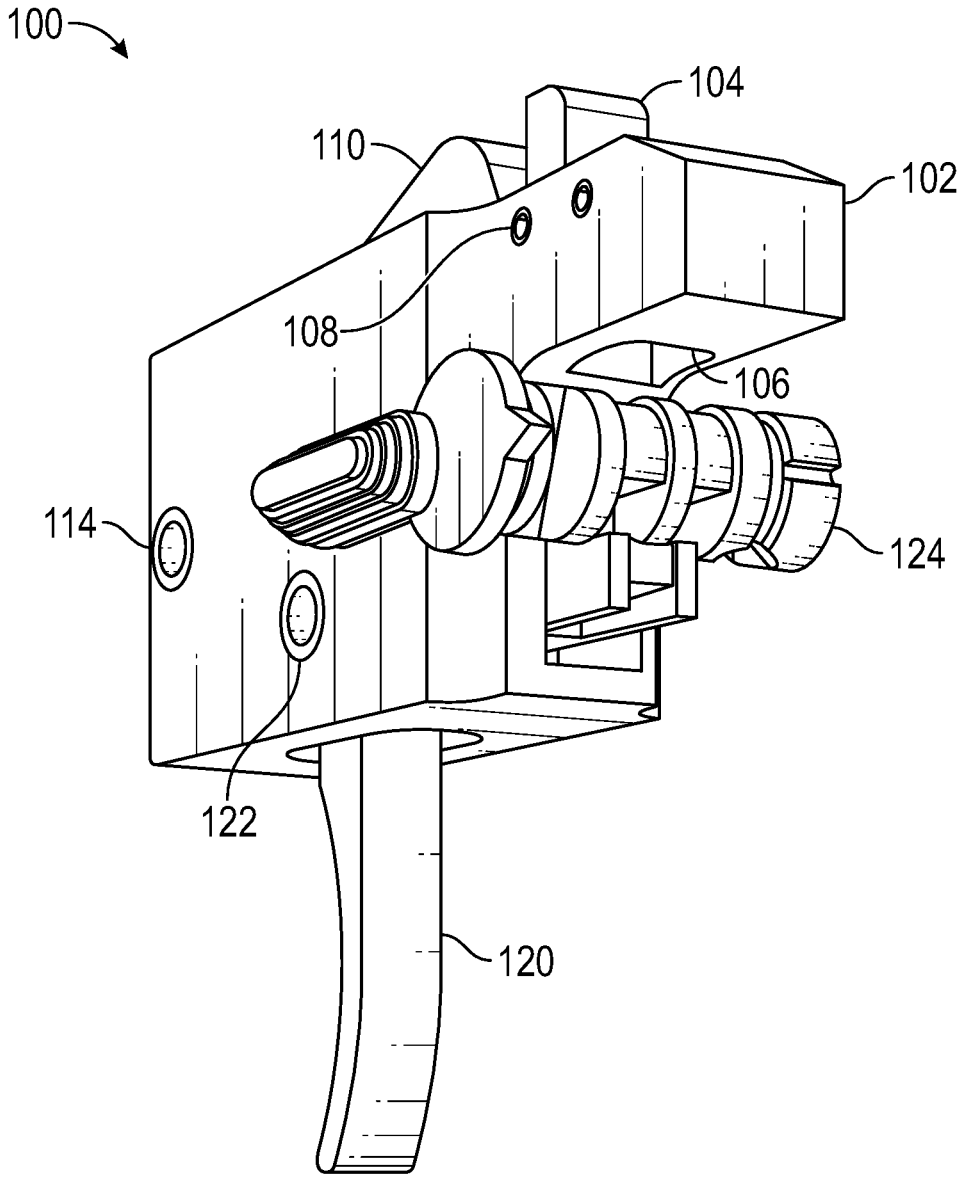
FIG. 1 illustrates a drop-in full automatic trigger group, according to an embodiment.

Drop-in full automatic trigger groups as disclosed herein will become better understood through a review of the following detailed description in conjunction with the figures. The detailed description and figures provide merely examples of the various embodiments of drop-in full automatic trigger groups. Many variations are contemplated for different applications and design considerations; however, for the sake of brevity and clarity, all the contemplated variations may not be individually described in the following detailed description. Those skilled in the art will understand how the disclosed examples may be varied, modified, and altered and not depart in substance from the scope of the examples described herein.

A conventional full-auto trigger group may include an assembly within a lower receiver of a firearm including a trigger, hammer, springs, and a selector switch. This assembly may be pinned directly to the frame of the lower receiver.

Conventionally, maintenance of this trigger assembly would require a maintainer to disassemble the trigger assembly, removing the components from the lower receiver one component at a time. Such disassembly may be necessary, for example, to replace worn or malfunctioning components of the trigger assembly, or to clean the components. Reassembly is then subsequently required.

Generally, the conventional process of disassembling, cleaning, and reassembling a trigger assembly can take upwards of 40 minutes. While in some situations, time may be available to perform this maintenance, in other settings, this time may be better spent on other tasks. For example, in a law enforcement setting, minimizing the time necessary for firearm maintenance is desirable.

Moreover, a conventional method of converting a semi-automatic firearm to be capable of full automatic operation requires special skills, including an ability to drill accurately located and sized holes through the lower receiver, without damaging the lower receiver. Furthermore, the conversion process is prone to error, and such errors in conversion (e.g., out-of-tolerance location of drilled holes or tensioning of springs) can lead to errors in operation, which could prove damaging to the firearm and dangerous to the operator thereof. One such error may include an improperly located sear pin hole. In this situation, the bolt carrier group may not properly enter battery when in the battery position, which presents at best a situation where the firearm cannot fire and at worst a situation where the firearm may misfire, which may include a breech explosion.

Implementations of drop-in full automatic trigger groups may address some or all the problems described above. A drop-in full automatic trigger group may be installable within a lower receiver of a firearm. The trigger group may a housing defined by a first trigger pin hole, a first hammer pin hole, and a first sear pin hole; a second trigger pin hole substantially collinear with the first trigger pin hole, a second hammer pin hole substantially collinear with the first hammer pin hole, and a second sear pin hole substantially collinear with the first sear pin hole. The trigger group may include a trigger mechanism, a hammer mechanism, and a sear mechanism disposed at least partially within the housing.

The trigger mechanism, hammer mechanism, sear mechanism, and a cam selector toggle may work together to provide for selectable safe, semi-automatic, and full automatic operation of the firearm.

Drop-in full automatic trigger groups may be used to rapidly convert a semi-automatic firearm to full automatic operation. To perform such a conversion, the user must remove the existing trigger group from the firearm's lower receiver, including the hammer, the trigger, the springs, the selector cam toggle, and associated pins. Following this, a drop-in full automatic trigger group may be inserted into the now-empty cavity within the lower receiver, and a cam selector toggle may be inserted through an existing cam selector toggle hole in the lower receiver, and the firearm may thus be converted for full automatic operation.

Implementations herein may provide an ability to swap out the trigger assembly of a firearm quickly, without the need for time-consuming disassembly. Particularly, the inventors have found that implementations herein have reduced the changeout time for the trigger assembly to 5 minutes or less, as compared to the 40-minute-plus time necessary for conventional trigger assemblies. Furthermore, implementations herein shorten the necessary time needed to convert a firearm from semi-automatic capability to full auto capability, which may assist law enforcement or military agencies purchasing and converting large quantities of firearms. Furthermore, by employing multiple drop-in full automatic trigger groups as disclosed herein, a firearm may be used with a first drop-in full automatic trigger groups while a second is being cleaned or otherwise maintained.

In addition to time saved, implementations herein remove the need for precisely located and drilled sear holes within the lower receiver when converting a semi-automatic firearm to full automatic operation. Such elimination of drilling removes a source of error and thus danger in the operation of the firearm, increasing safety and operational effectiveness.

FIG. 1 illustrates a drop-in full automatic trigger group 100, according to an embodiment. Drop-in full-automatic trigger group 100 may provide for fast interchange of a full rigger group for a full automatic firearm. Alternately, drop-in full-automatic trigger group 100 may provide for fast conversion of semi-automatic firearm to a full automatic firearm.

Full-automatic trigger group 100 may include a trigger group housing 102, which may provide a support basis for other components of full-automatic trigger group 100. The trigger group housing 102 may be shaped to contain components of full-automatic trigger group 100 and fit within a lower receiver of a firearm (e.g., an ARMALITE® Rifle style lower receiver). Components of full-automatic trigger group 100 may further include a full automatic sear 104, a pin 108, a hammer 110, a hammer pin 114, a trigger 120, a trigger pin 122, a full auto sear spring 106, and a selector cam toggle 124. Trigger 120 may be attached to trigger group housing 102 via trigger pin 122 installed within corresponding holes in trigger group housing 102 and trigger 120. Hammer 110 may be attached to trigger group housing 102 via hammer pin 114 installed within corresponding holes of trigger group housing 102 and hammer 110. Full automatic sear 104 may be attached to trigger group housing 102 via sear pin 108 installed within corresponding holes of trigger group housing 102 and full automatic sear 104. Full auto sear spring 106 may be installed within trigger group housing 102 to provide compressive force acting between trigger group housing 102 and full automatic sear 104 to retain full automatic sear 104 in its home or operative position, depending on a configuration of selector cam toggle 124. Selector cam toggle 124 may be positioned to act upon trigger 120, hammer 110, and/or full automatic sear 104 to provide selection between, for example, safe, semi-automatic, and full automatic modes.

Full-automatic trigger group 100 may be insertable within a lower receiver of a firearm. To effect this, trigger pin 122 may be disposed at least partially within the first trigger pin hole and the second trigger pin hole such that both ends of trigger pin 122 are substantially flush with exterior surfaces of trigger group housing 102. Hammer pin 114 may be disposed at least partially within the first trigger pin hole and the second trigger pin hole such that both ends of hammer pin 114 are substantially flush with exterior surfaces of trigger group housing 102. Sear pin 108 may be disposed at least partially within the first trigger pin hole and the second trigger pin hole such that both ends of sear pin 108 are substantially flush with exterior surfaces of trigger group housing 102.

Figure 2:
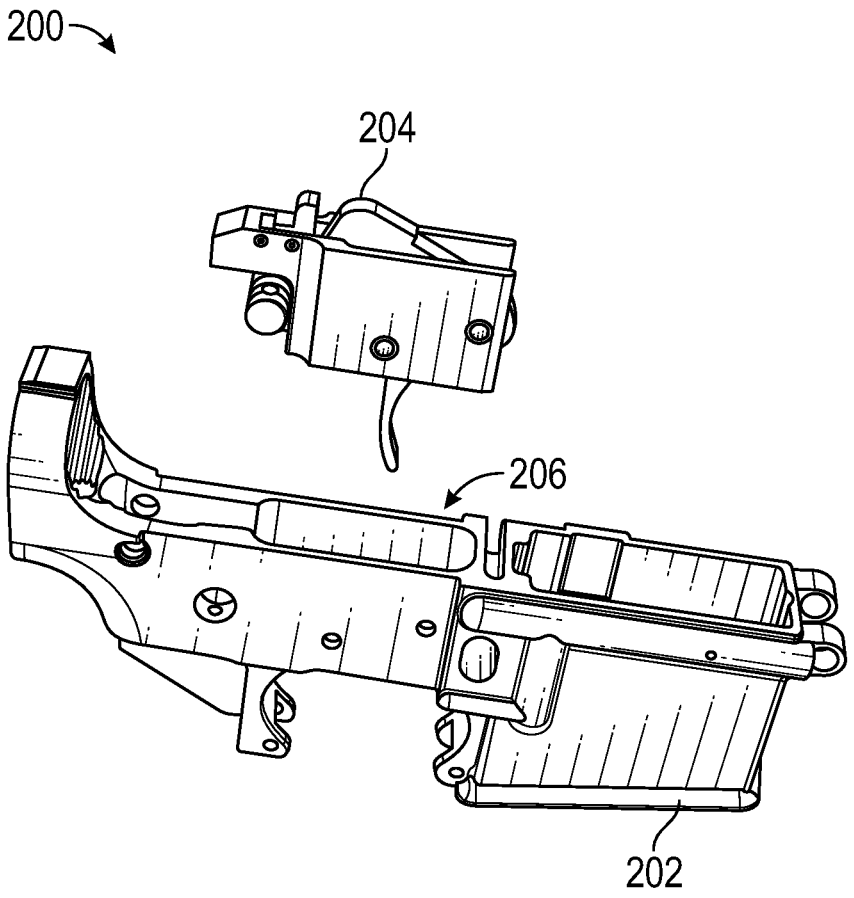
FIG. 2 illustrates an assembled lower receiver including a drop-in full automatic trigger group and a lower receiver frame, according to an embodiment.

FIG. 2 illustrates an assembled lower receiver 200 including a drop-in full automatic trigger group 202 and a lower receiver frame 204, according to an embodiment. Assembled lower receiver 200 may provide for full automatic operation of a firearm, regardless of original design of the firearm. In this way, an existing full automatic firearm may benefit from the quick changeout time of full automatic trigger group 202 and an existing semi-automatic firearm may, in addition, benefit from quick and accurate conversion to full automatic operation.

Assembled lower receiver 200 may include full automatic trigger group 202 and lower receiver frame 204. In operation, a maintainer of a firearm may remove any existing trigger components from lower receiver frame 204, if necessary, and install full automatic trigger group 202 into lower receiver frame 204. This installation may be accomplished, inter alia, by dropping full automatic trigger group 202 into a trigger group cavity 206 of lower receiver frame 204 and inserting a selector cam toggle through existing selector cam toggle holes of lower receiver frame 204 to engage with the trigger, hammer, and sear mechanisms of full automatic trigger group 202.

Figure 3:
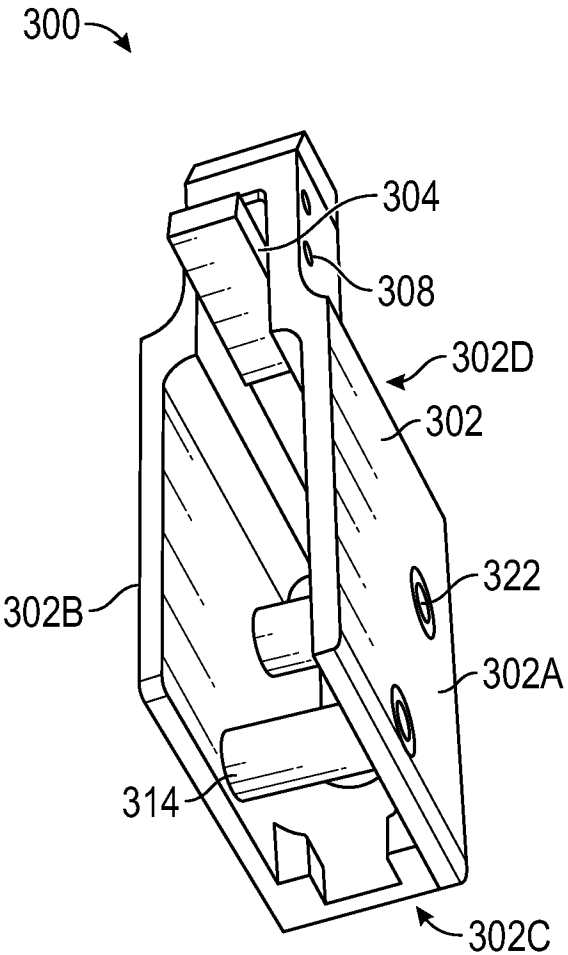
FIG. 3 illustrates a housing assembly of a drop-in full automatic trigger group, according to an embodiment.

FIG. 3 illustrates a housing assembly 300 of a drop-in full automatic trigger group, according to an embodiment. Housing assembly 300 may fit within a lower receiver of a predetermined firearm, group of firearms, or class of firearms. To this effect, housing assembly 300 may be insertable within the lower receiver of the given firearm(s) in place of the components of factory-installed trigger groups.

Housing assembly 300 may include a trigger group housing 302. Trigger group housing 302 may include a first sidewall 302A, a second sidewall 302B, a bottom wall 302C, and a front wall 302D. First sidewall 302A may be arranged substantially parallel to second sidewall 302B. First sidewall 302A may be further defined by a first trigger pin hole, a first hammer pin hole, and a first sear pin hole. Second sidewall 302B may be further defined by a second trigger pin hole substantially collinear with the first trigger pin hole, a second hammer pin hole substantially collinear with the first hammer pin hole, and a second sear pin hole substantially collinear with the first sear pin hole. Bottom wall 302C may extend between first sidewall 302A and second sidewall 302B such that bottom wall 302C is substantially perpendicular to first sidewall 302A and second sidewall 302B. Front wall 302D may extend between first sidewall 302A and second sidewall 302B such that front wall 302D is substantially perpendicular to first sidewall 302A, second sidewall 302B, and bottom wall 302C.

Holes may be located to further define trigger group housing 302. Such holes may include holes for receiving a hammer pin 314, a trigger pin 322, and a sear pin 308. Sear pin 308 may pin full automatic sear 304 to trigger group housing 302.

Housing 300 may in some embodiments include DELRON®, aluminum, steel, or other suitable plastics to reduce weight and heat retention.

Figure 4:
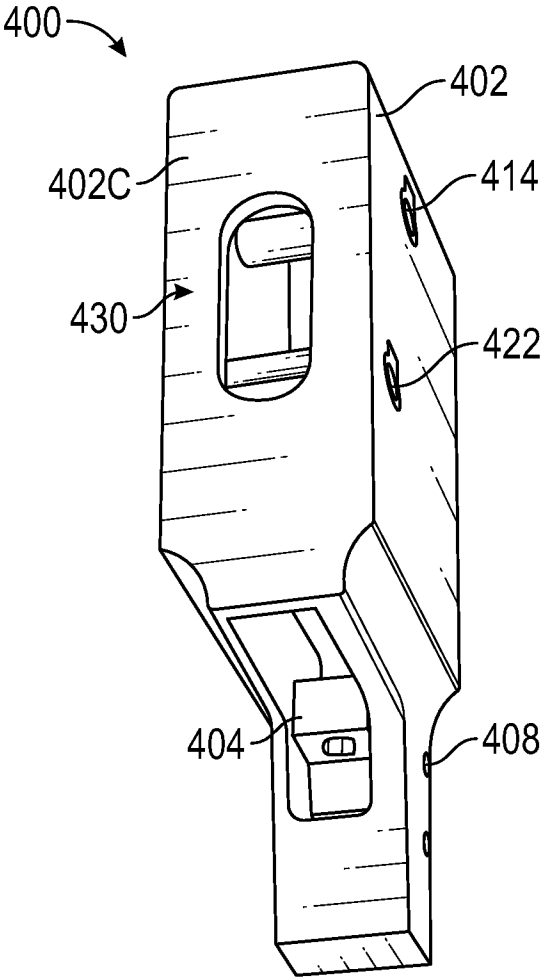
FIG. 4 illustrates an alternate view of a housing assembly of a drop-in full automatic trigger group, according to an embodiment.

FIG. 4 illustrates an alternate view of a housing assembly 400 of a drop-in full automatic trigger group, according to an embodiment. Housing assembly 400 may hold a trigger mechanism, a hammer mechanism, and a sear mechanism. These mechanisms may be attached to housing assembly 400 by one or more pins.

Housing assembly 400 may include a trigger group housing 402. Trigger group housing 402 may include, inter alia, a bottom wall 402C.

Holes may be located to further define trigger group housing 402. Such holes may include holes for receiving a hammer pin 414, a trigger pin 422, and a sear pin 408. Sear pin 408 may pin full automatic sear 404 to trigger group housing 402. A further hole 430 may further define bottom wall 402C. Hole 430 may be sized to permit insertion of a trigger therethrough such that the trigger is operable.

Figure 5:
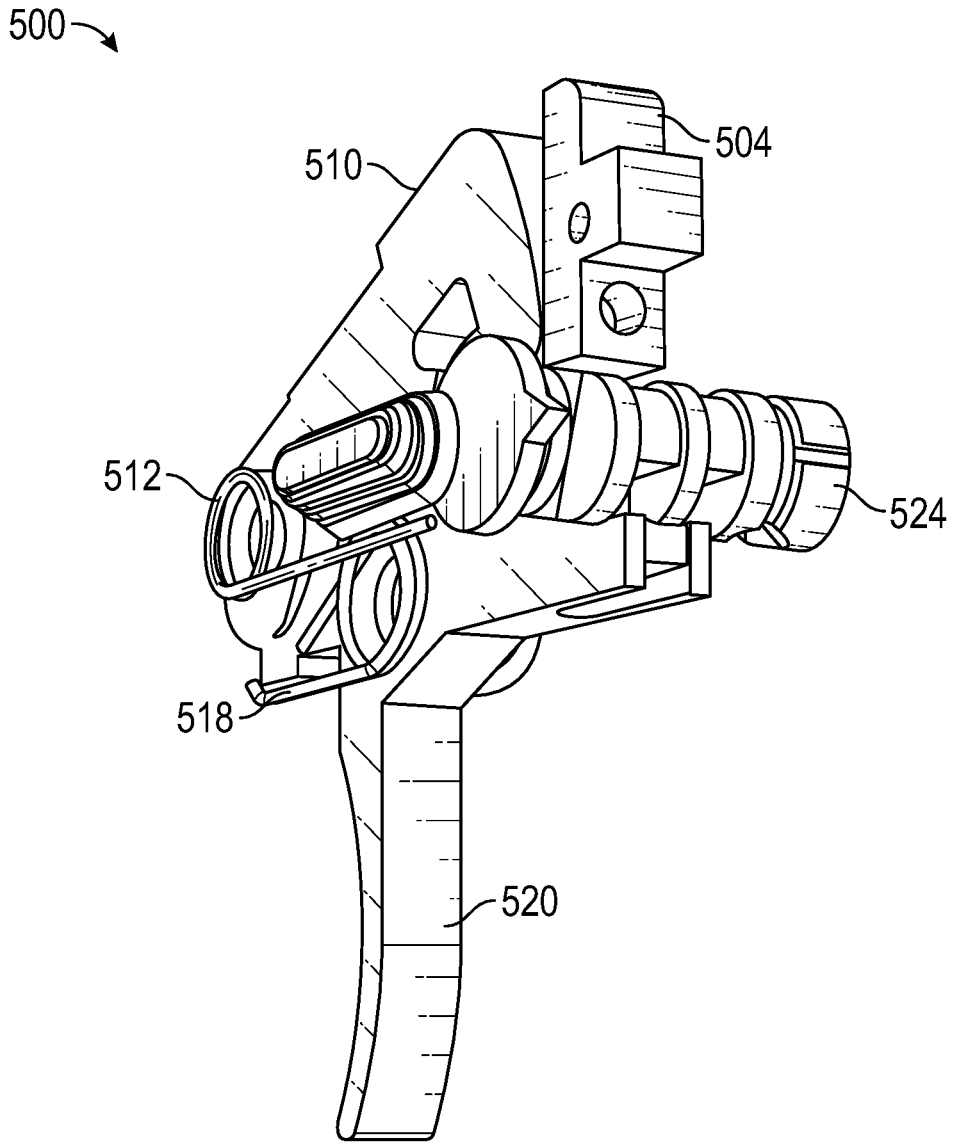
FIG. 5 illustrates an operative mechanism of a drop-in full automatic trigger group, according to an embodiment.

FIG. 5 illustrates an operative mechanism 500 of a drop-in full automatic trigger group, according to an embodiment. Operative mechanism 500 may include subassemblies for trigger, hammer, and sear operation.

Operative mechanism 500 may include a full automatic sear 504, a hammer 510, a hammer spring 512, a trigger 520, a trigger spring 518, and a selector cam toggle 524. Such full automatic sear 504, hammer 510, hammer spring 512, trigger 520, trigger spring 518, and selector cam toggle 524 may be arranged operatively for operation of a firearm into which operative mechanism 500 may be installed. Components of operative mechanism 500 may in some embodiments include mild steel, which may be hardened and phosphic acid coated.

Trigger spring 518 may be in operative contact with a housing and trigger 520, and it may apply a compressive force to trigger 520 such that when a squeezing force is applied to trigger 520 in a first direction of travel from a home position, trigger 520 moves in the first direction of travel and when the squeezing force is removed from trigger 520 in the first direction of travel, trigger 520 returns to the home position.

Hammer spring 512 may be in operative contact with the housing and hammer 510, and it may be configured to apply a compressive force to hammer 510 such that when a retaining force is applied to hammer 510 in a cocked position, hammer spring 512 is under a first compression force and when the retaining force is removed from hammer 510 in the cocked position, hammer 510 releases and hammer spring 512 shifts to a second compression force smaller than the first compression force.

In operation, when full automatic sear 504 is impinged upon by a bolt carrier group during recoil after firing of the firearm within which operative mechanism 500 is installed, full automatic sear 504 enables the hammer to repeatedly release so long as trigger 520 remains depressed.

Figure 6:
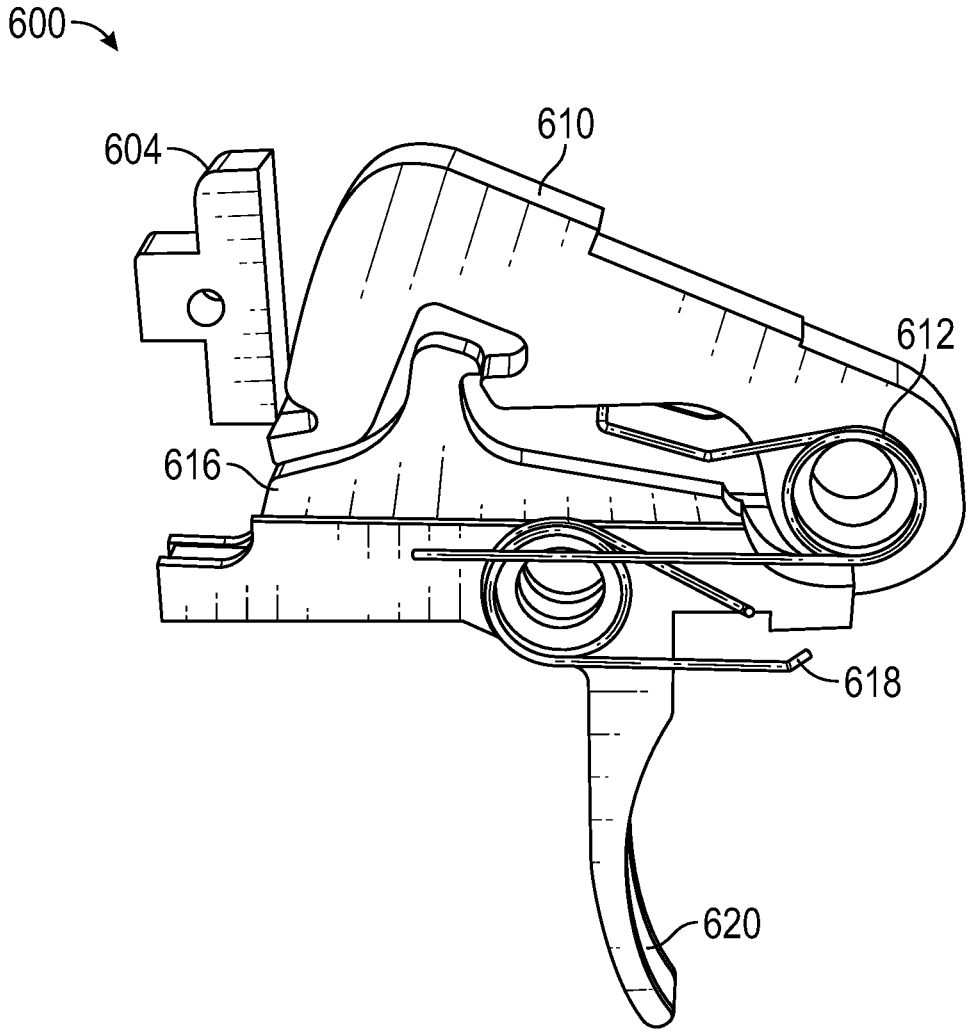
FIG. 6 illustrates a trigger-hammer-sear assembly of an operative mechanism of a drop-in full automatic trigger group, according to an embodiment.

FIG. 6 illustrates a trigger-hammer-sear assembly 600 of an operative mechanism of a drop-in full automatic trigger group, according to an embodiment. Trigger-hammer-sear subassembly 600 may operate together with a selector cam toggle to provide for full automatic operation of a firearm.

Trigger-hammer-sear assembly 600 may include a full automatic sear 604, a hammer 610, a hammer spring 612, a trigger 620, a trigger spring 618, and a disconnector 616. Such full automatic sear 604, hammer 610, hammer spring 612, trigger 620, trigger spring 618, and disconnector 616 may be arranged operatively for operation of a firearm into which trigger-hammer-sear assembly 600 may be installed. Disconnector 616 may enable hammer 610 to be held in place after acting upon of the trigger-hammer-sear assembly 600 by a bolt carrier during recoil after firing until trigger 620 is released, thus enabling semi-automatic operation of the firearm. Components of trigger-hammer-sear assembly 600 may in some embodiments include mild steel, which may be hardened and phosphic acid-coated.

Figure 7:
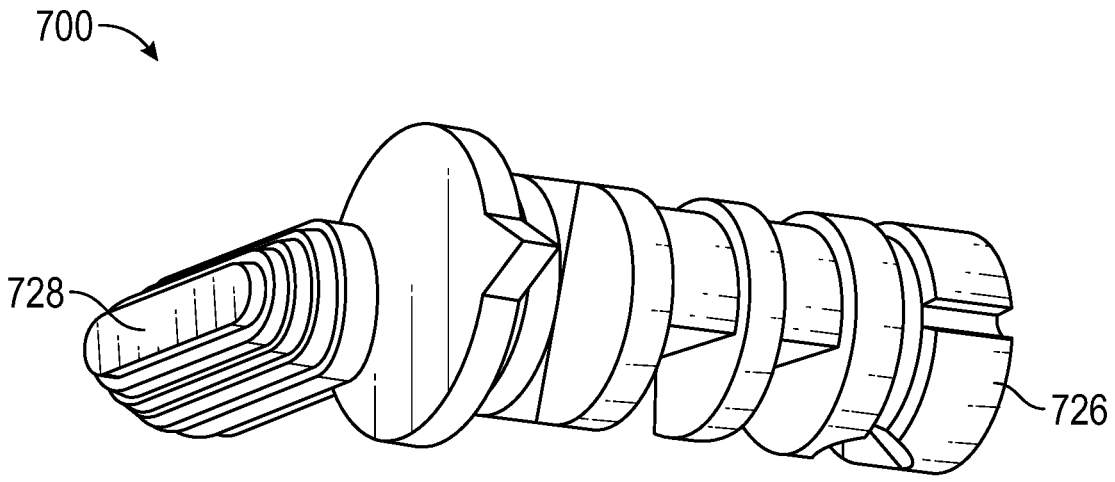
FIG. 7 illustrates a selector cam toggle of an operative mechanism of a drop-in full automatic trigger group, according to an embodiment.

FIG. 7 illustrates a selector cam toggle 700 of an operative mechanism of a drop-in full automatic trigger group, according to an embodiment. Selector cam toggle 700 may operate together with a trigger-hammer-sear subassembly to provide for full automatic operation of a firearm.

Selector cam toggle 700 may include a selector cam 726 and a selector toggle 728. Selector cam toggle 700 may be insertable within a selector cam toggle hole of a lower receiver of a firearm such that it is in operative contact with a trigger-hammer-sear assembly within a trigger group housing. Selector toggle 728 may remain exposed outside of the lower receiver such that a user can rotate selector cam toggle 700 to select safe, semi-automatic, and full automatic modes, for example. Selector cam 726, when installed, may be disposed within the lower receiver and within a trigger group housing, such that varying layers of selector cam 726 act on various components of the trigger-hammer-sear assembly to vary operation of the trigger-hammer-sear assembly, thus varying the modes of the firearm.

Figure 8:
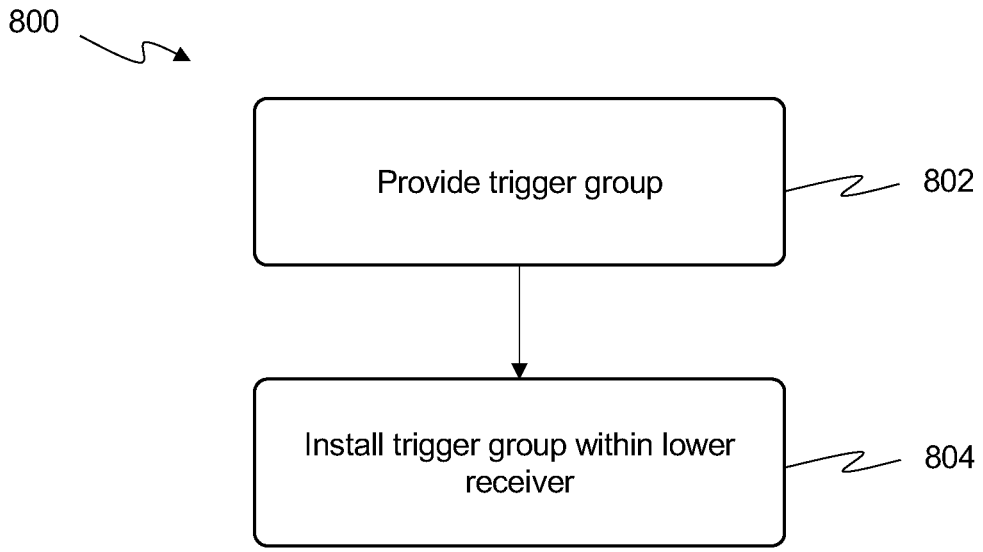
FIG. 8 illustrates a flowchart of a method of installing a drop-in full automatic trigger group within a firearm, according to an embodiment.

FIG. 8 illustrates a flowchart of a method 800 of installing a drop-in full automatic trigger group within a firearm, according to an embodiment. Method 800 may provide for rapid replacement of a trigger group from a firearm, or conversion of a firearm from semi-automatic operation to full automatic operation. The method 800 may alleviate the needs of a maintainer of a firearm to modify the lower receiver body of the firearm or install multiple different components of a standard trigger group within the lower receiver body of the firearm.

At 802, a trigger group installable within a lower receiver of a firearm may be provided. The trigger group may include a housing defined by a first trigger pin hole, a first hammer pin hole, and a first sear pin hole; a second trigger pin hole substantially collinear with the first trigger pin hole, a second hammer pin hole substantially collinear with the first hammer pin hole, and a second sear pin hole substantially collinear with the first sear pin hole, a trigger mechanism disposed at least partially within the housing, a hammer mechanism disposed at least partially within the housing; and a sear mechanism disposed at least partially within the housing.

At 804, the trigger group may be disposed simultaneously within a lower receiver of a firearm. A selector cam toggle may then be inserted through an existing selector cam toggle hole in the lower receiver, and the installation of the trigger group may be complete.

Figure 9:
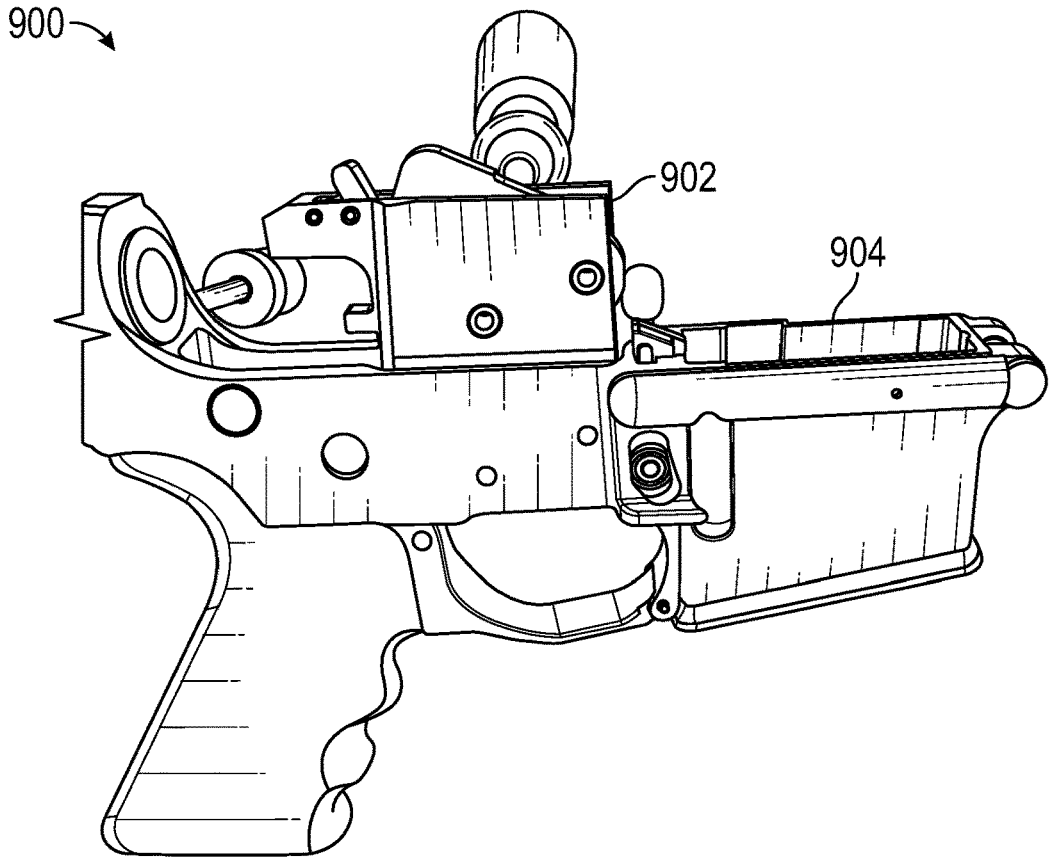
FIG. 9 illustrates a partially-installed arrangement of a trigger group and a lower receiver, according to an embodiment.

FIG. 9 illustrates a partially-installed arrangement 900 of a trigger group 902 and a lower receiver 904, according to an embodiment. Arrangement 900 may illustrate the positioning of trigger group 902 and lower receiver 904 just prior to insertion of trigger group 902 into lower receiver 904. Arrangement 900 may display the orientation of trigger group 902 in relation to lower receiver 904.

Figure 10:
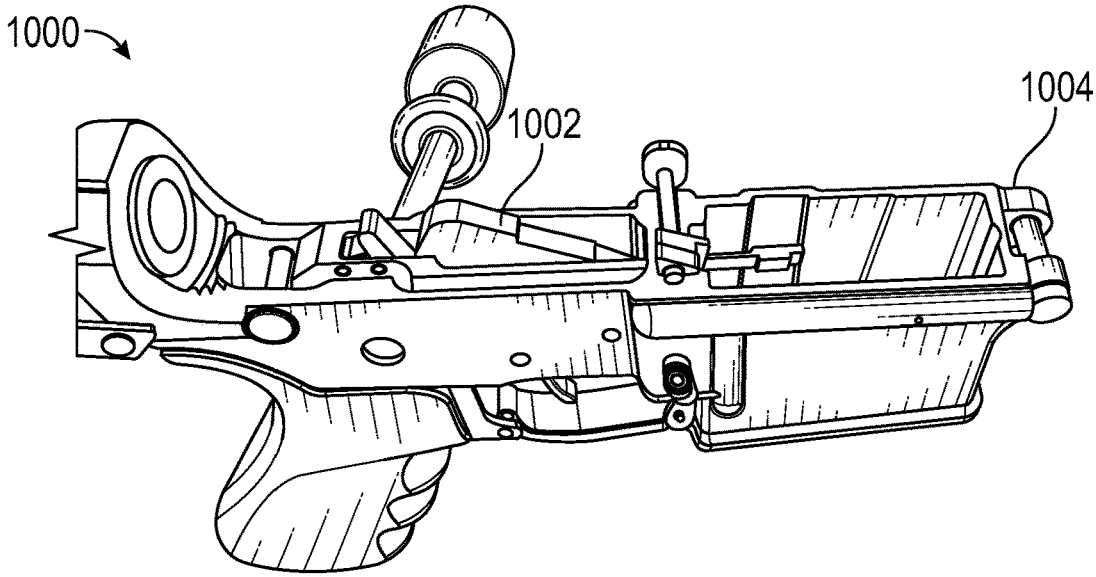
FIG. 10 illustrates an installed arrangement of a trigger group and a lower receiver, according to an embodiment.

FIG. 10 illustrates an installed arrangement 1000 of a trigger group 1002 and a lower receiver 1004, according to an embodiment. Arrangement 1000 may illustrate the positioning and orientation of trigger group 1002 within lower receiver 1004 when trigger group 1002 is installed within lower receiver 1004.

A feature illustrated in one of the figures may be the same as or similar to a feature illustrated in another of the figures. Similarly, a feature described in connection with one of the figures may be the same as or similar to a feature described in connection with another of the figures. The same or similar features may be noted by the same or similar reference characters unless expressly described otherwise. Additionally, the description of a particular figure may refer to a feature not shown in the particular figure. The feature may be illustrated in and/or further described in connection with another figure.

Elements of processes (i.e. methods) described herein may be executed in one or more ways such as by a human, by a processing device, by mechanisms operating automatically or under human control, and so forth. Additionally, although various elements of a process may be depicted in the figures in a particular order, the elements of the process may be performed in one or more different orders without departing from the substance and spirit of the disclosure herein.

The foregoing description sets forth numerous specific details such as examples of specific systems, components, methods and so forth, in order to provide a good understanding of several implementations. It will be apparent to one skilled in the art, however, that at least some implementations may be practiced without these specific details. In other instances, well-known components or methods are not described in detail or are presented in simple block diagram format in order to avoid unnecessarily obscuring the present implementations. Thus, the specific details set forth above are merely exemplary. Particular implementations may vary from these exemplary details and still be contemplated to be within the scope of the present implementations.

Related elements in the examples and/or embodiments described herein may be identical, similar, or dissimilar in different examples. For the sake of brevity and clarity, related elements may not be redundantly explained. Instead, the use of a same, similar, and/or related element names and/or reference characters may cue the reader that an element with a given name and/or associated reference character may be similar to another related element with the same, similar, and/or related element name and/or reference character in an example explained elsewhere herein. Elements specific to a given example may be described regarding that particular example. A person having ordinary skill in the art will understand that a given element need not be the same and/or similar to the specific portrayal of a related element in any given figure or example in order to share features of the related element.

It is to be understood that the foregoing description is intended to be illustrative and not restrictive. Many other implementations will be apparent to those of skill in the art upon reading and understanding the above description. The scope of the present implementations should, therefore, be determined with reference to the appended claims, along with the full scope of equivalents to which such claims are entitled.

The foregoing disclosure encompasses multiple distinct examples with independent utility. While these examples have been disclosed in a particular form, the specific examples disclosed and illustrated above are not to be considered in a limiting sense as numerous variations are possible. The subject matter disclosed herein includes novel and non-obvious combinations and sub-combinations of the various elements, features, functions and/or properties disclosed above both explicitly and inherently. Where the disclosure or subsequently filed claims recite "a" element, "a first" element, or any such equivalent term, the disclosure or claims is to be understood to incorporate one or more such elements, neither requiring nor excluding two or more of such elements.

As used herein "same" means sharing all features and "similar" means sharing a substantial number of features or sharing materially important features even if a substantial number of features are not shared. As used herein "may" should be interpreted in a permissive sense and should not be interpreted in an indefinite sense. Additionally, use of "is" regarding examples, elements, and/or features should be interpreted to be definite only regarding a specific example and should not be interpreted as definite regarding every example. Furthermore, references to "the disclosure" and/or "this disclosure" refer to the entirety of the writings of this document and the entirety of the accompanying illustrations, which extends to all the writings of each subsection of this document, including the Title, Background, Brief description of the Drawings, Detailed Description, Claims, Abstract, and any other document and/or resource incorporated herein by reference.

As used herein regarding a list, "and" forms a group inclusive of all the listed elements. For example, an example described as including A, B, C, and D is an example that includes A, includes B, includes C, and also includes D. As used herein regarding a list, "or" forms a list of elements, any of which may be included. For example, an example described as including A, B, C, or D is an example that includes any of the elements A, B, C, and D. Unless otherwise stated, an example including a list of alternatively-inclusive elements does not preclude other examples that include various combinations of some or all of the alternatively-inclusive elements. An example described using a list of alternatively-inclusive elements includes at least one element of the listed elements. However, an example described using a list of alternatively-inclusive elements does not preclude another example that includes all of the listed elements. And, an example described using a list of alternatively-inclusive elements does not preclude another example that includes a combination of some of the listed elements. As used herein regarding a list, "and/or" forms a list of elements inclusive alone or in any combination. For example, an example described as including A, B, C, and/or D is an example that may include: A alone; A and B; A, B and C; A, B, C, and D; and so forth. The bounds of an "and/or" list are defined by the complete set of combinations and permutations for the list.

Where multiples of a particular element are shown in a FIG., and where it is clear that the element is duplicated throughout the FIG., only one label may be provided for the element, despite multiple instances of the element being present in the FIG. Accordingly, other instances in the FIG. of the element having identical or similar structure and/or function may not have been redundantly labeled. A person having ordinary skill in the art will recognize based on the disclosure herein redundant and/or duplicated elements of the same FIG. Despite this, redundant labeling may be included where helpful in clarifying the structure of the depicted examples.

The Applicant(s) reserves the right to submit claims directed to combinations and sub-combinations of the disclosed examples that are believed to be novel and non-obvious. Examples embodied in other combinations and sub-combinations of features, functions, elements and/or properties may be claimed through amendment of those claims or presentation of new claims in the present application or in a related application. Such amended or new claims, whether they are directed to the same example or a different example and whether they are different, broader, narrower or equal in scope to the original claims, are to be considered within the subject matter of the examples described herein.

The invention claimed is:

1. A system, comprising:

a trigger group configured for installation within a lower receiver of a firearm, the trigger group including:

a housing, including:

a first sidewall;

a second sidewall;

a bottom wall; and a front wall;

wherein:

the first sidewall, second sidewall, and front wall define a protruding end extending longitudinally from a first portion of the front wall;

the protruding end is further defined by the first and second side walls curving inward towards an interior of the housing and a second portion of the front wall angled outward away from the first portion of the front wall;

the first sidewall is arranged substantially parallel to the second sidewall;

the first sidewall is further defined by a first trigger pin hole, a first hammer pin hole, and a first sear pin hole;

the second sidewall is further defined by:

a second trigger pin hole substantially collinear with the first trigger pin hole, a second hammer pin hole substantially collinear with the first hammer pin hole, and a second sear pin hole substantially collinear with the first sear pin hole;

the bottom wall extends between the first sidewall and the second sidewall such that the bottom wall is substantially perpendicular to the first sidewall and the second sidewall; and the front wall extends between the first sidewall and the second sidewall such that the front wall is substantially perpendicular to the first sidewall, the second sidewall, and the bottom wall;

a trigger mechanism disposed at least partially within the housing; and a hammer mechanism disposed at least partially within the housing.

2. The system of claim 1, wherein the trigger mechanism comprises a trigger disposed at least partially within the housing.

3. The system of claim 2, wherein the trigger mechanism further comprises a trigger spring in operative contact with the housing and the trigger and configured to apply a compressive force to the trigger such that:

when a squeezing force is applied to the trigger in a first direction of travel from a home position, the trigger moves in the first direction of travel; and when the squeezing force is removed from the trigger in the first direction of travel, the trigger returns to the home position.

4. The system of claim 2, wherein the trigger group further comprises a trigger pin disposed at least partially within the first trigger pin hole and the second trigger pin hole.

5. The system of claim 4, wherein the trigger pin is disposed within the first trigger pin hole and the second trigger pin hole such that:

a first end of the trigger pin is flush with a first exterior surface of the first sidewall; and a second end of the trigger pin is flush with a second exterior surface of the second sidewall.

6. The system of claim 1, wherein the hammer mechanism comprises a hammer disposed at least partially within the housing.

7. The system of claim 6, wherein the hammer mechanism further comprises a hammer spring in operative contact with the housing and the hammer and configured to apply a compressive force to the hammer such that:

when a retaining force is applied to the hammer in a cocked position, the hammer spring is under a first compression force; and when the retaining force is removed from the hammer in the cocked position, the hammer releases and the hammer spring shifts to a second compression force smaller than the first compression force.

8. The system of claim 6, wherein the trigger group further comprises a hammer pin disposed at least partially within the first hammer pin hole and the second hammer pin hole.

9. The system of claim 8, wherein the hammer pin is disposed within the first hammer pin hole and the second hammer pin hole such that:

a first end of the hammer pin is flush with a first exterior surface of the first sidewall; and a second end of the hammer pin is flush with a second exterior surface of the second sidewall.

10. The system of claim 1, wherein the trigger group further comprises a sear pin disposed at least partially within the first sear pin hole and the second sear pin hole.

11. The system of claim 10, wherein the sear pin is disposed within the first sear pin hole and the second sear pin hole such that:

a first end of the sear pin is flush with a first exterior surface of the first sidewall; and a second end of the sear pin is flush with a second exterior surface of the second sidewall.

12. The system of claim 10, wherein the trigger group further comprises a sear.

13. The system of claim 12, wherein the sear comprises a sear body, including a parallelepiped portion and a protrusion extending therefrom, wherein the sear body is further defined by a sear body pin hole extending through the sear body.

14. The system of claim 13, wherein the trigger group further comprises a sear pin disposed at least partially within the first sear pin hole, the second sear pin hole, and the sear body pin hole such that the sear is constrained to rotate about a sear pin axis of the sear pin.

15. A method, comprising:

providing a trigger group configured for installation within a lower receiver of a firearm, the trigger group including:

a housing defined by a first trigger pin hole, a first hammer pin hole, and a first sear pin hole; a second trigger pin hole substantially collinear with the first trigger pin hole, a second hammer pin hole substantially collinear with the first hammer pin hole, a second sear pin hole substantially collinear with the first sear pin hole, and a protruding end formed by a first surface, second surface, and third surface of the housing;

the protruding end is further defined by the first and second surfaces curving inward towards an interior of the housing and a first portion of the third surface angled outward away from a second portion of the third surface;

a trigger mechanism disposed at least partially within the housing;

a hammer mechanism disposed at least partially within the housing; and a sear mechanism disposed at least partially within the protruding front end of the housing; and disposing the trigger group simultaneously within a lower receiver of a firearm.

16. The method of claim 15, wherein prior to disposing the trigger group simultaneously within the lower receiver of the firearm, the firearm is a semi-automatic firearm or a full automatic firearm.

17. The method of claim 15, further comprising removing, from the firearm, a factory-installed trigger mechanism and a factory-installed hammer mechanism.

18. The method of claim 17, further comprising removing, from the firearm, a factory-installed sear mechanism.

19. A system, comprising:

a trigger group configured for installation within a lower receiver of a firearm, the trigger group including:

a housing defined by a first trigger pin hole, a first hammer pin hole, and a first sear pin hole; a second trigger pin hole substantially collinear with the first trigger pin hole, a second hammer pin hole substantially collinear with the first hammer pin hole, a second sear pin hole substantially collinear with the first sear pin hole, and a protruding end formed by a first surface, second surface, and third surface of the housing;

the protruding end is further defined by the first and second surfaces curving inward towards an interior of the housing and a first portion of the third surface angled outward away from a second portion of the third surface;

a trigger mechanism disposed at least partially within the housing, the trigger mechanism including:

a trigger;

a trigger pin; and a trigger spring;

a hammer mechanism disposed at least partially within the housing, the hammer mechanism including:

a hammer;

a hammer pin; and a hammer spring; and a sear mechanism disposed at least partially within the housing, the sear mechanism including:

a sear; and a sear pin.

20. The system of claim 19, wherein:

the trigger pin is disposed at least partially within the first trigger pin hole and the second trigger pin hole such that a first trigger pin end and a second trigger pin end are substantially flush with an exterior surface of the housing;

the hammer pin is disposed at least partially within the first hammer pin hole and the second hammer pin hole such that a first hammer pin end and a second hammer pin end are substantially flush with the exterior surface of the housing; and the sear pin is disposed at least partially within the first sear pin hole and the second sear pin hole such that a first sear pin end and a second sear pin end are substantially flush with the exterior surface of the housing.

* * * * *